US005966104A

United States Patent [19]

Massey et al.

[11] Patent Number: 5,966,104

[45] Date of Patent: Oct. 12, 1999

[54] ANTENNA HAVING MOVABLE REFLECTORS

[75] Inventors: Cameron G. Massey, Hawthorne; Mark T. Austin, Mira Loma; Peter D. Anderson, Redondo Beach; Miguel A. Estevez, Culver City; Michael Nolan; Clifford R. Harper, both of Torrance; Terry R. Denardo, San Pedro; John J. Sennikoff, Brea; Martin M. Skredsvig, M.B., all of Calif.

[73] Assignee: Hughes Electronics Corporation, Los Angeles, Calif.

[21] Appl. No.: 09/052,407

[22] Filed: Mar. 31, 1998

[51] Int. Cl.[6] ..... H01Q 1/28; H01Q 1/08

[52] U.S. Cl. ..... 343/915; 343/881; 343/882; 343/DIG. 2

[58] Field of Search ..... 343/915, DIG. 2, 343/881, 880, 871

[56] References Cited

U.S. PATENT DOCUMENTS

| | | | |
|---|---|---|---|
| 4,489,329 | 12/1984 | Vezain et al. | 343/705 |
| 4,550,319 | 10/1985 | Gansle et al. | 343/882 |
| 4,625,214 | 11/1986 | Parckh | 343/756 |
| 4,647,938 | 3/1987 | Roederer et al. | 343/756 |
| 4,771,293 | 9/1988 | Williams et al. | 343/757 |
| 5,642,122 | 6/1997 | Lockie et al. | 343/881 |
| 5,806,351 | 10/1995 | Learnahan | 70/56 |

*Primary Examiner*—Don Wong
*Assistant Examiner*—James Clinger
*Attorney, Agent, or Firm*—Terje Gudmestad; Georgann S. Grunebach; Michael W. Sales

[57] ABSTRACT

An antenna having dual reflectors connected by a moving mechanism for moving the reflectors between stowed and deployed positions. In the stowed position the reflectors overlap and are positioned close to each other. In the deployed position the reflectors are spaced apart.

9 Claims, 8 Drawing Sheets

ANTENNA HAVING MOVABLE REFLECTORS

TECHNICAL FIELD

The present invention relates generally to an antenna having dual reflectors and, more particularly, to an antenna having dual reflectors in which the reflectors are movable with respect to one another.

BACKGROUND ART

Antennas have dual reflectors for transmitting and receiving signals such as in frequency reuse applications. One of the reflectors is fed by a feed for transmitting a signal and the other reflector feeds another feed with a received signal. The feeds are typically located adjacent each other. To properly focus the signal beams between the reflectors and the adjacent feeds, the reflectors overlap each other and are spaced apart at specified angles and distances along their surfaces in a deployed position.

Launching of satellites imposes strict requirements concerning size, weight, and resistance to acceleration forces of the payload. Prior art dual reflectors are fixed spaced apart in the deployed position with respect to one another. Because the position of the reflectors is fixed, the reflectors take up a large volume. Quite often the payload envelopes of the satellites cannot store the fixed reflectors. The solution to this problem automatically implies a large-size launch configuration of the satellite.

This solution has obvious disadvantages. What is needed is an antenna that has dual reflectors which are movable with respect to each other between stowed and deployed positions. With these features, the reflectors could fit into a small payload in the stowed position and then expand into the deployed position once the satellite reaches orbit.

SUMMARY OF THE INVENTION

Accordingly, it is an object of the present invention to provide an antenna having dual reflectors which are movable with respect to one another.

It is another object of the present invention to provide an antenna having dual reflectors connected by a moving mechanism for moving the reflectors between a stowed position, in which the reflectors overlap and are positioned close to each other, and a deployed position in which the reflectors are spaced apart.

It is a further object of the present invention to provide an antenna having dual reflectors hinged together at one end and connected together by a moving mechanism at the other end so that the reflectors are movable with respect to one another.

It is still another object of the present invention to provide a moving mechanism for connecting two reflectors of an antenna for moving the reflectors between stowed and deployed positions.

It is still a further object of the present invention to provide a satellite having an antenna with movable dual reflectors so that in a stowed position the reflectors take up less volume than the volume consumed in a deployed position.

In carrying out the above objects and other objects, the present invention provides an antenna having a first reflector, a second reflector, and a moving mechanism. The moving mechanism connects the reflectors and is movable to move the reflectors between a stowed position in which the reflectors overlap each other and a deployed position in which the reflectors are separated from each other.

The advantages accruing to the present invention are numerous. Because the reflectors are movable with respect to one another, they can be packaged into a launch vehicle without violating the envelope of the launch vehicle. Thus, the strict launching requirements concerning the payload may be met in more situations.

Furthermore, the reflectors are connected at one end by a moving mechanism which, because of its position on the outer periphery of the reflectors, does not electrically interfere with the signals. In contrast, with some prior art antennas, centrally located structure fixing the reflectors in a permanently spaced apart deployed position adversely affects the signals such as by causing phase changes.

These and other features, aspects, and embodiments of the present invention will become better understood with regard to the following description, appended claims, and accompanying drawings.

BEST MODES FOR CARRYING OUT THE INVENTION

Figure 1:
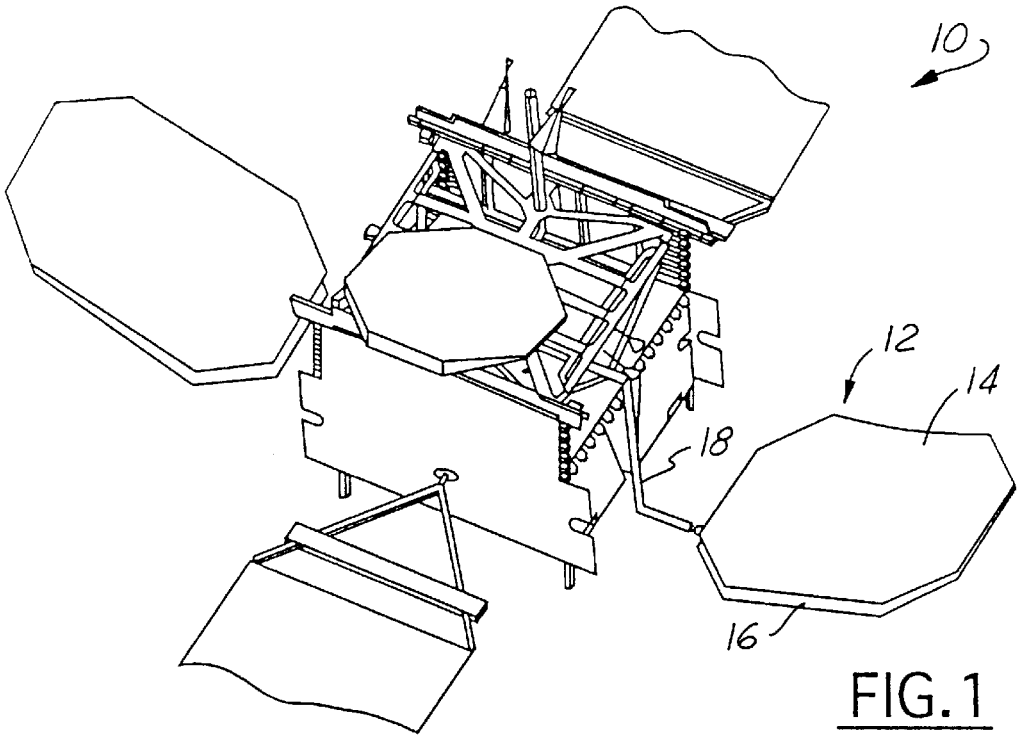
FIG. 1 is a perspective view of a satellite employing the antenna of the present invention.

Referring now to FIG. 1, a satellite 10 provided with an antenna having dual reflectors 12 is shown. Reflectors 12 include a front shell (front reflector) 14 and a rear shell (rear reflector) 16. A boom 18 connects reflectors 12 to satellite 10. Front shell 14 and rear shell 16 are operable with respective feeds (not specifically shown) to transmit and receive electromagnetic signals. For example, one feed operates in linear polarization, for instance horizontal, reflected by front shell 14. The other feed operates in linear orthogonal polarization, for instance vertical, reflected by rear shell 16.

Figure 2A:
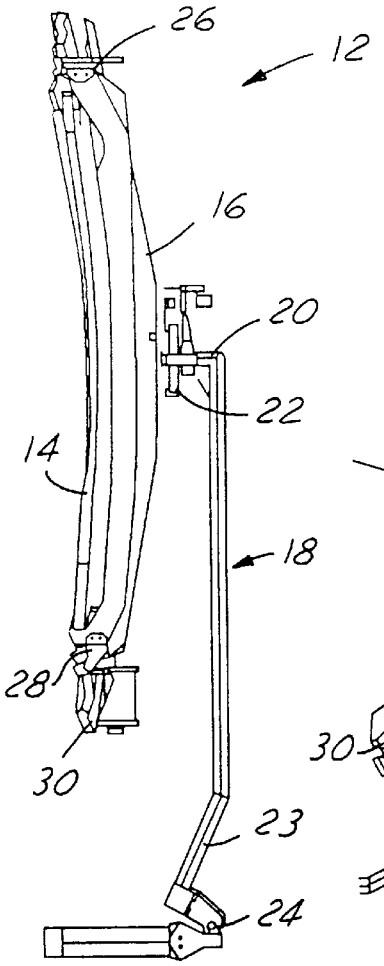
FIG. 2A is a view of the dual reflectors of the antenna shown in FIG. 1 connected to a boom and positioned at an initial position.
Figure 2B:
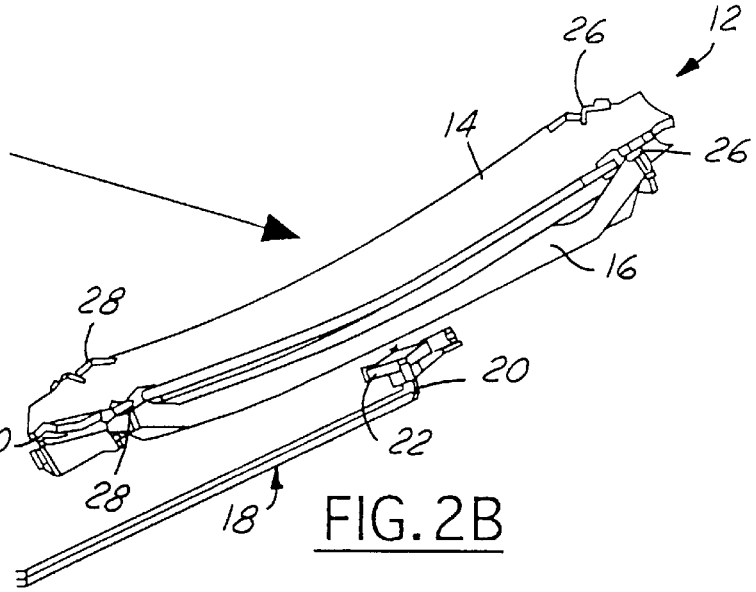
FIG. 2B is a view of the dual reflectors pivoted by the boom from the initial position to a given position with the reflectors remaining spaced closely together in the stowed position.
Figure 2C:
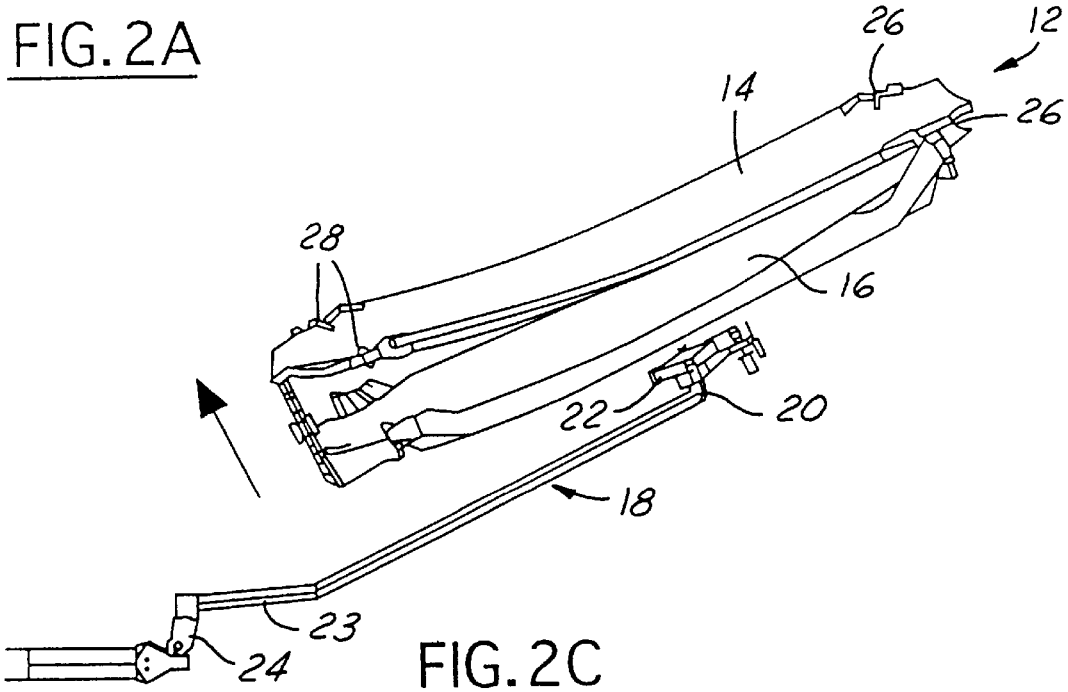
FIG. 2C is a view of the dual reflectors in the deployed position with the reflectors being spaced apart.

Turning now to FIGS. 2A, 2B, and 2C, boom 18 is connected at a distal end 20 to a plate 22 on rear shell 16. A proximate end 23 of boom 18 is connected to a pivotal connection 24 to pivot reflectors 12. As shown in FIG. 2A, reflectors 12 are positioned by boom 18 at an initial upright position in space. Reflectors 12 are also maintained in a stowed position in which front shell 14 and rear shell 16 overlap each other and are spaced closely together. A pair of forward launch locks 26 and a pair of aft launch locks 28 secure front shell 14 to rear shell 16 in the stowed position.

Boom 18 then pivots about pivotal connection 24 to move reflectors 12 from the initial position to a given position as shown in FIG. 2B. Forward launch locks 26 and aft launch locks 28 fire simultaneously to become unlocked as boom 18 pivots reflectors 12 to the given position.

Reflectors 12 further include a moving mechanism 30 connecting front shell 14 and rear shell 16. Moving mechanism 30 is positioned between aft launch locks 28 and connects the outer peripheral portions of shells 14 and 16 adjacent the aft launch locks.

After the launch locks 26 and 28 have fired, a controller (not specifically shown) actuates moving mechanism 30 to move front shell 14 away from rear shell 16 as shown in FIG. 2C. Moving mechanism 30 moves shells 14 and 16 to a predetermined spaced apart position such that the shells are in a deployed position. In the deployed position, shells 14 and 16 are operable with respective feeds of the antenna of satellite 10 to transmit and receive signals. Further, in the deployed position, shells 14 and 16 still overlap one another, but are spaced apart at predetermined angles and distances along their surfaces.

Figure 3A:
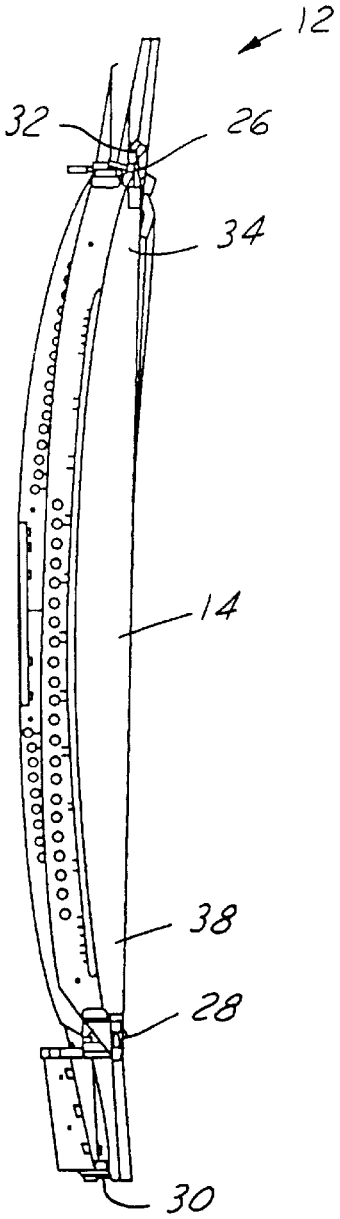
FIG. 3A is a side view of the dual reflectors in the stowed position with the reflectors being spaced closely together.
Figure 3B:
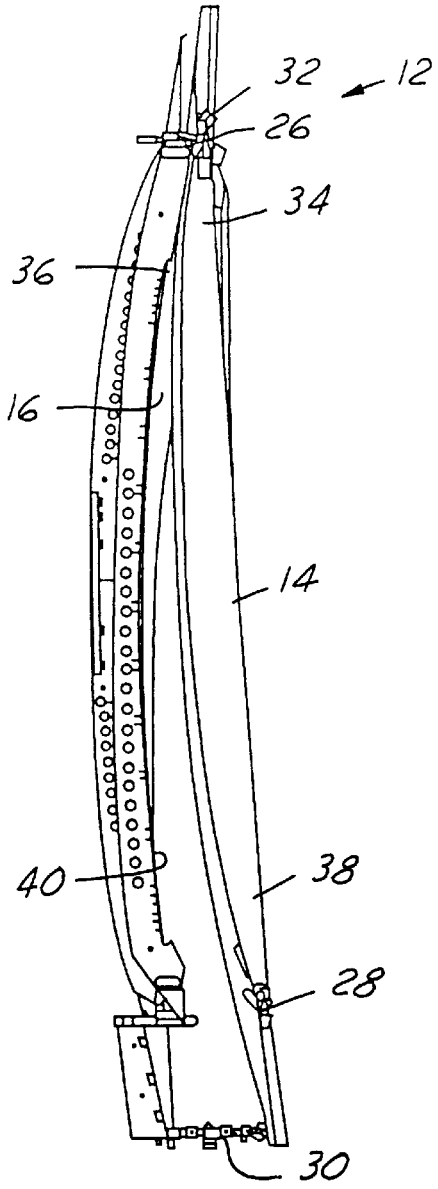
FIG. 3B is a side view of the dual reflectors in the deployed position with the reflectors being spaced apart.

Referring now to FIGS. 3A and 3B, the relative movement of shells 14 and 16 will be described in further detail. In FIG. 3A, reflectors 12 are in the stowed position. In FIG. 3B, launch locks 26 and 28 have been fired and moving mechanism 30 has been actuated to move reflectors 12 to the deployed position.

To move into the deployed position, front shell 14 pivots about hinges 32 (shown in greater detail in FIG. 8A) adjacent respective forward launch locks 26. Near hinges 32, end portion 34 of front shell 14 and end portion 36 of rear shell 16 are spaced apart relatively close when reflectors 12 are in the deployed position. End portion 38 of front shell 14 and end portion 40 of rear shell 40 adjacent aft launch locks 28 are spaced apart relatively far when reflectors 12 are in the deployed position.

Figure 4:
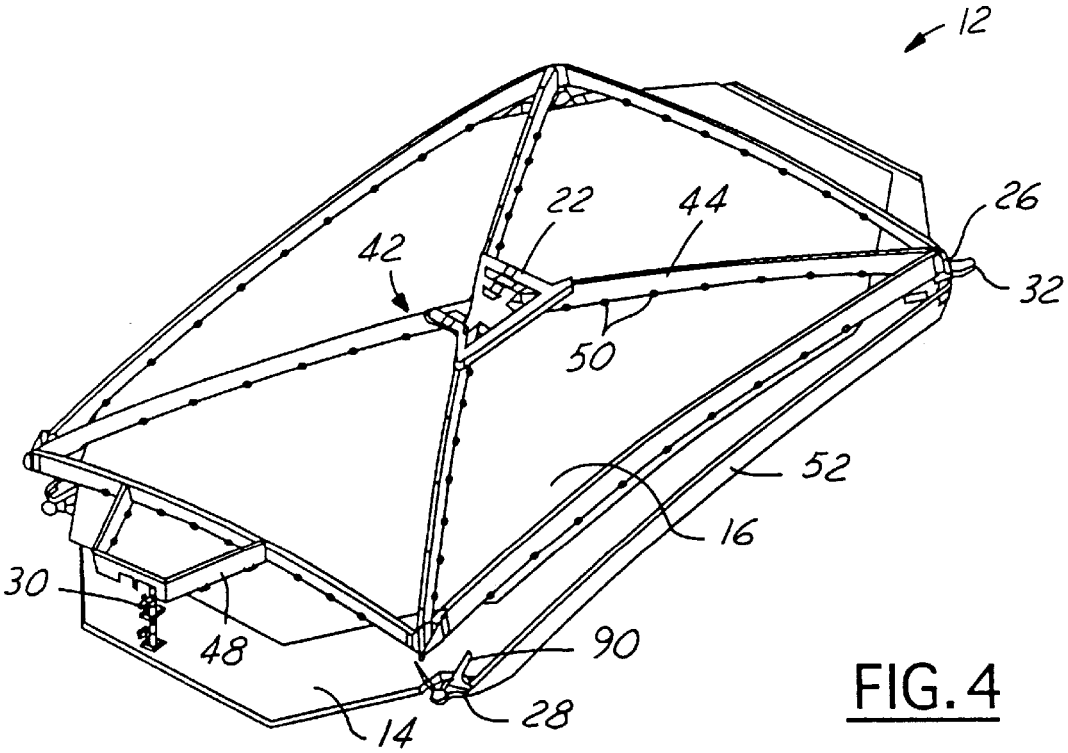
FIG. 4 is a rear view of the dual reflectors in the deployed position with the reflectors being spaced apart.

Referring now to FIG. 4, with continual reference to FIGS. 3A and 3B, reflectors 12 further include a rib frame 42. Rib frame 42 includes an X rib portion 44, a square rib portion 46, and a tab rib portion 48. Rear shell 16 is connected to rib frame 42 for support. A plurality of angle clips 50 tie rear shell 16 to rib frame 42. Moving mechanism 30 connects front shell 14 to the portion of rear shell 16 connected to tab rib portion 48. Plate 22 is also connected to X rib portion 44. Boom 18 connects with plate 22 as shown in FIG. 1 such that reflectors 12 are center mounted. Front shell 14 includes a pair of opposed side panels 52.

Figure 5A:
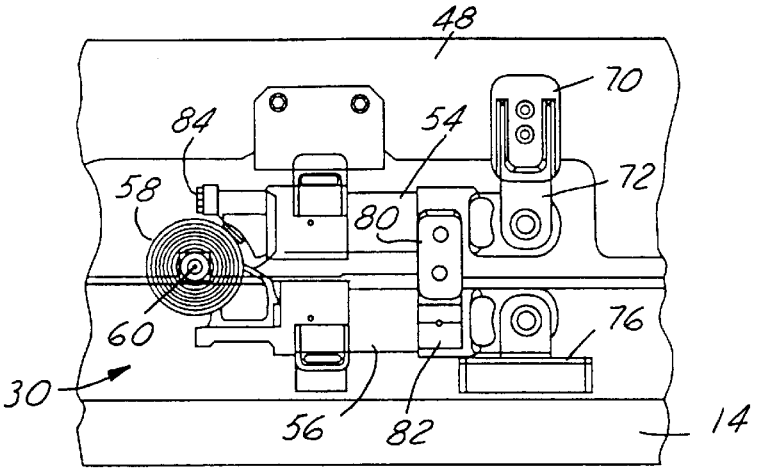
FIG. 5A is a side view of a moving mechanism connecting the reflectors in the stowed position.
Figure 5B:
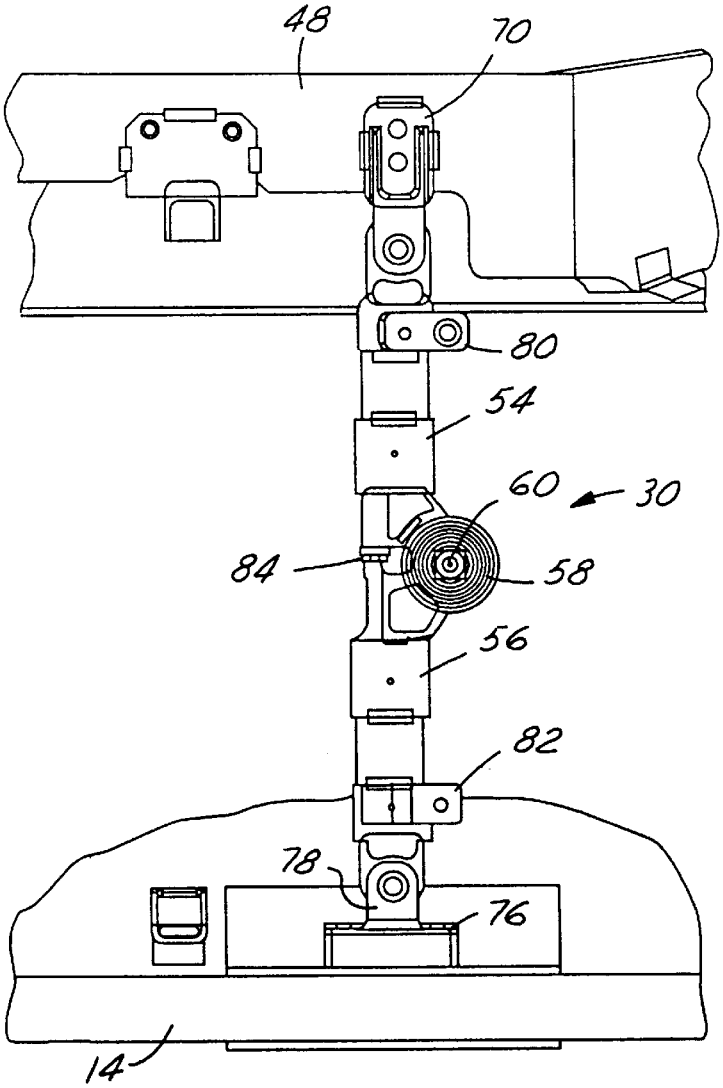
FIG. 5B is a side view of the moving mechanism connecting the reflectors in the deployed position.
Figure 6A:
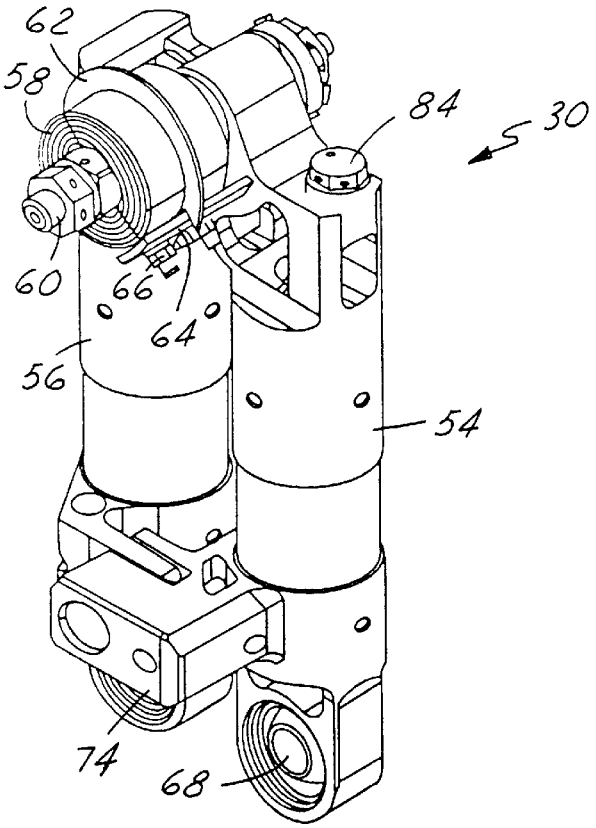
FIG. 6A is a perspective view of the moving mechanism in a stowed configuration.
Figure 6B:
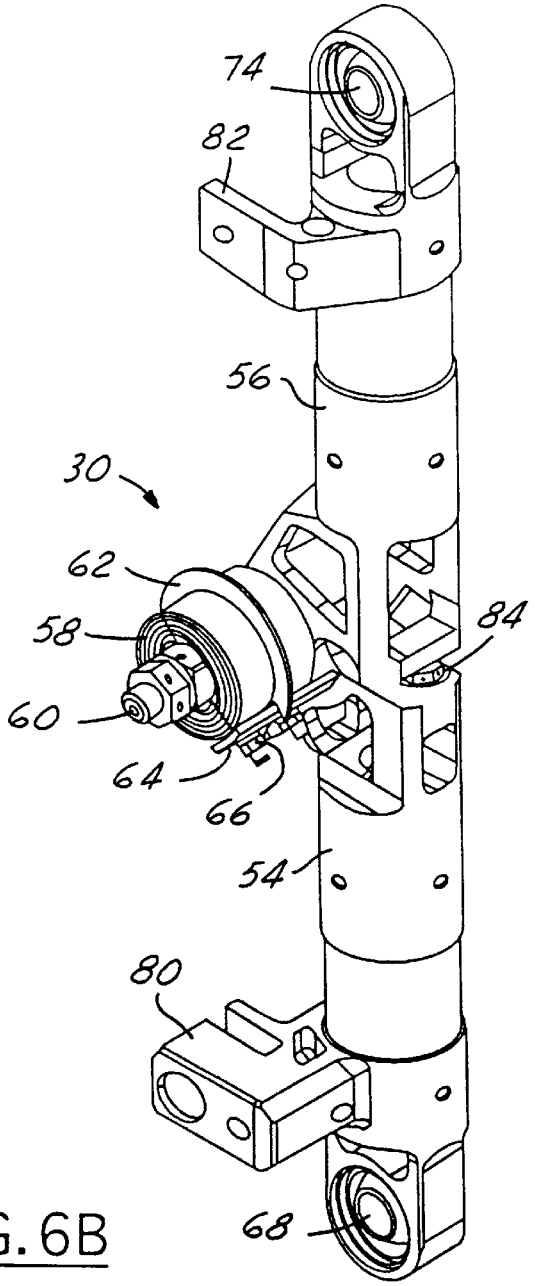
FIG. 6B is a perspective view of the moving mechanism in a deployed configuration.

Looking now to FIGS. 5A, 5B, 6A, and 6B, moving mechanism 30 is shown in greater detail. Moving mechanism 30 is shown in FIGS. 5A and 6A in the stowed configuration. Moving mechanism 30 is in the stowed configuration when reflectors 12 are in the stowed position as shown in FIG. 5A. Moving mechanism 30 is shown in FIGS. 5B and 6B in the deployed configuration. Moving mechanism 30 is in the deployed configuration when reflectors 12 are in the deployed position as shown in FIG. 5B.

Moving mechanism 30, a pyrotechnic device, is preferably a spring-loaded hinge. Spring-loaded hinge 30 includes a rear support cylinder segment 54 and a front support cylinder segment 56. Segments 54 and 56 are connected by dual springs 58 and a pivot pin 60. Dual springs 58 include two springs separated by a spring divider 62. Dual springs 58 are tensioned to force segments 54 and 56 to pivot away from each other on pivot pin 60.

More particularly, dual springs 58 are mounted to a support tab 64 at spring attach points 66. Support tab 64 extends from rear segment 54. Thus, dual springs 58 cause to force front segment 56 to pivot away from rear segment 54 on pivot pin 60.

Rear segment 54 includes a loader slot mono-ball 68. A bracket 70 connects mono-ball 68 to tab rib portion 48 which is connected to rear shell 16. Bracket 70 is connected by fasteners extending through tab rib portion 48. Bracket 70 includes a pivot segment 72 on which mono-ball 68 rotates.

Similarly, front segment 56 includes a loader slot mono-ball 74. A bracket 76 connects mono-ball 74 to front shell 14. Bracket 76 is connected by fasteners extending through front shell 14. Bracket 76 also includes a pivot segment 78 on which mono-ball 74 rotates.

Rear segment 54 further includes a female launch lock clevis 80 and front segment 56 further includes a corresponding male launch lock clevis 82. Clevises 80 and 82 are configured to be locked together when spring-loaded hinge 30 is in the stowed configuration. Clevises 80 and 82 are also configured to be actuated by a pin puller (not specifically shown) and unlock to enable segments 54 and 56 of spring-loaded hinge 30 to move to the deployed configuration.

An adjustable stop 84 is connected to rear segment 54. Adjustable stop 84 extends upwards from rear segment 54 and may be adjusted to vary the amount of extension of front segment 56. Adjustable stop 84 engages front segment 56 to limit the pivoting of segments 54 and 56 as desired.

Figure 7A:
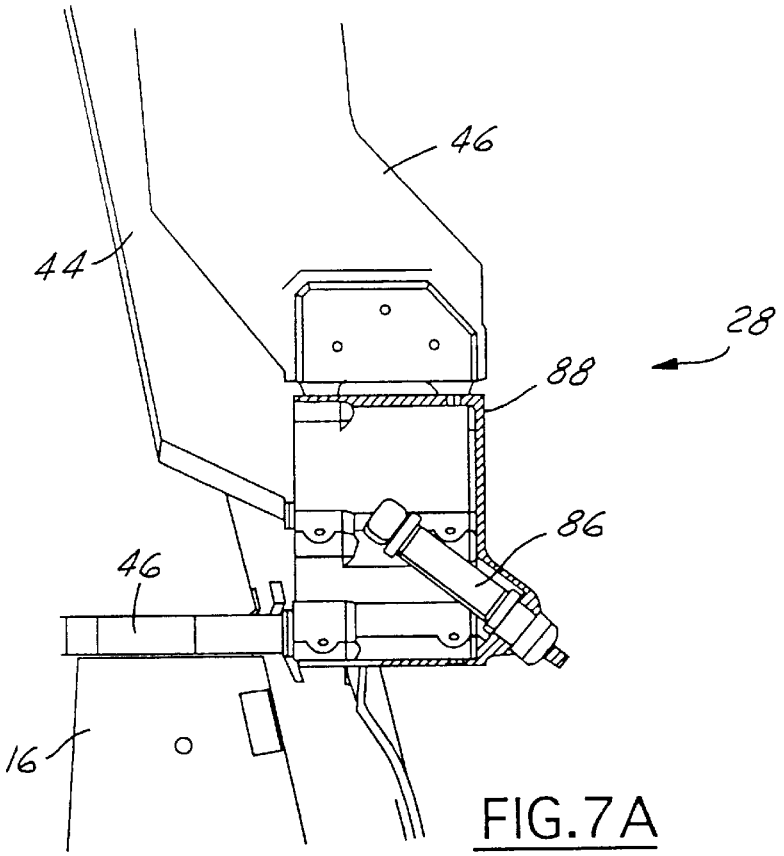
FIG. 7A is a cut away view of an aft launch lock connecting the reflectors.
Figure 7B:
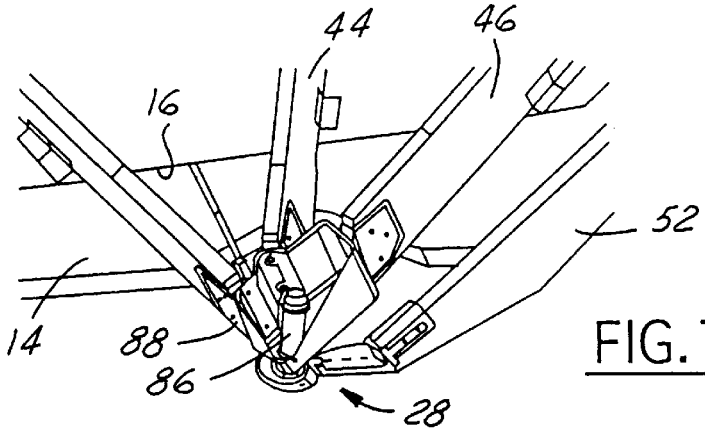
FIG. 7B is a view of the aft launch lock looking from the rear reflector.
Figure 7C:
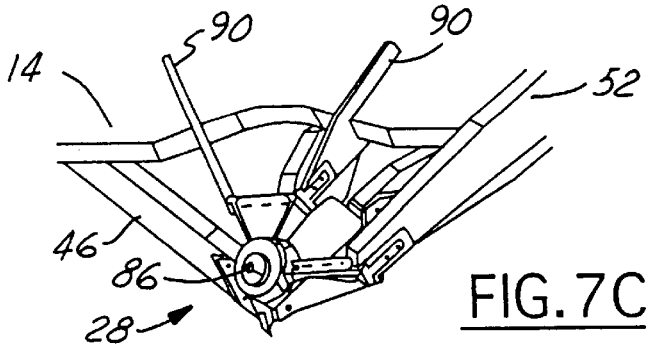
FIG. 7C is a view of the aft launch lock looking from the front reflector.

Directing attention now to FIGS. 7A, 7B, and 7C, aft launch locks 28 will be described in greater detail. Locks 28 are pyrotechnic devices and are generally similar to each other. Thus, only one of locks 28 is shown.

Aft launch lock 28 includes a fastener 86. Fastener 86 mounts to a corner bracket 88 which connects X rib frame portion 44 and square rib portion 46. Aft launch lock 28 further includes a pair of riblets 90 (also shown in FIG. 4) which engage front shell 14 when reflectors 12 are in the stowed position. Riblets 90 are secured to corner bracket 88 by fastener 86. As a result, aft launch lock 28 secures front shell 14 to rear shell 16 when fastener 86 engages corner bracket 88.

Once satellite 10 is in orbit, a controller (not specifically shown) actuates aft launch lock 28 such that fastener 86 disengages with corner bracket 88. Thus, front shell 14 is not impeded by aft launch lock 28 to move away from rear shell 16 when spring-loaded hinge 30 is actuated.

Figure 8A:
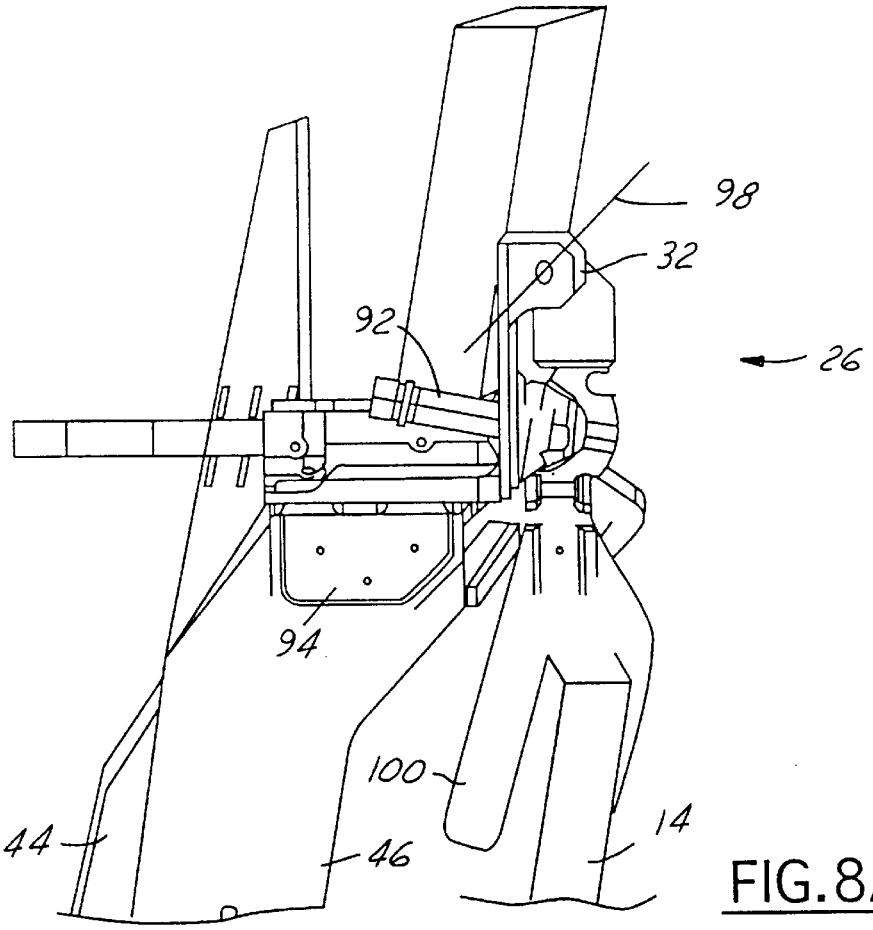
FIG. 8A is a view of a forward launch lock connecting the reflectors.
Figure 8B:
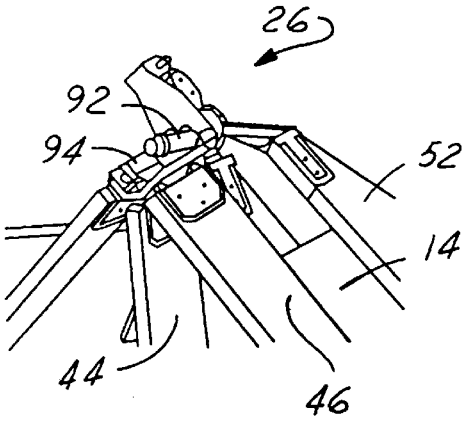
FIG. 8B is a view of the forward launch lock looking from the rear reflector.
Figure 8C:
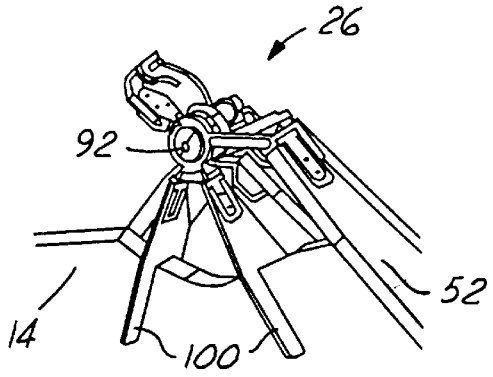
FIG. 8C is a view of the forward launch lock looking from the front reflector.

Directing attention now to FIGS. 8A, 8B, and 8C, forward launch locks 26 will be described in greater detail. Locks 26 are pyrotechnic devices and are generally similar to each other. Thus, only one of locks 26 is shown.

Forward launch lock 26 includes a fastener 92. Fastener 92 mounts to a bracket 94 which connects X rib frame portion 44 and square rib portion 46. Forward launch lock 26 further includes hinge 32. Hinge 32 defines a hinge axis 98.

Forward launch lock 26 further includes a pair of riblets 100 which engage front shell 14 when reflectors 12 are in the stowed position. Riblets 100 are secured to bracket 94 by fastener 92. As a result, forward launch lock 26 secures front shell 14 to rear shell 16 when fastener 92 engages bracket 94.

Once satellite 10 is in orbit, a controller (not specifically shown) actuates forward launch lock 26 such that fastener 92 disengages with bracket 94. Front shell 14 is then free to pivot about hinge axis 98 to move away from rear shell 16.

Figure 9A:
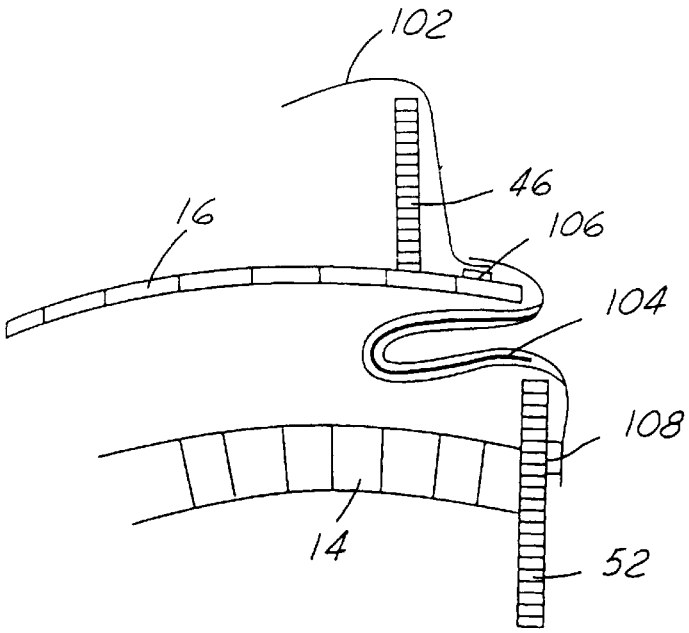
FIG. 9A is a view of the reflectors in the stowed position with a blanket cover.
Figure 9B:
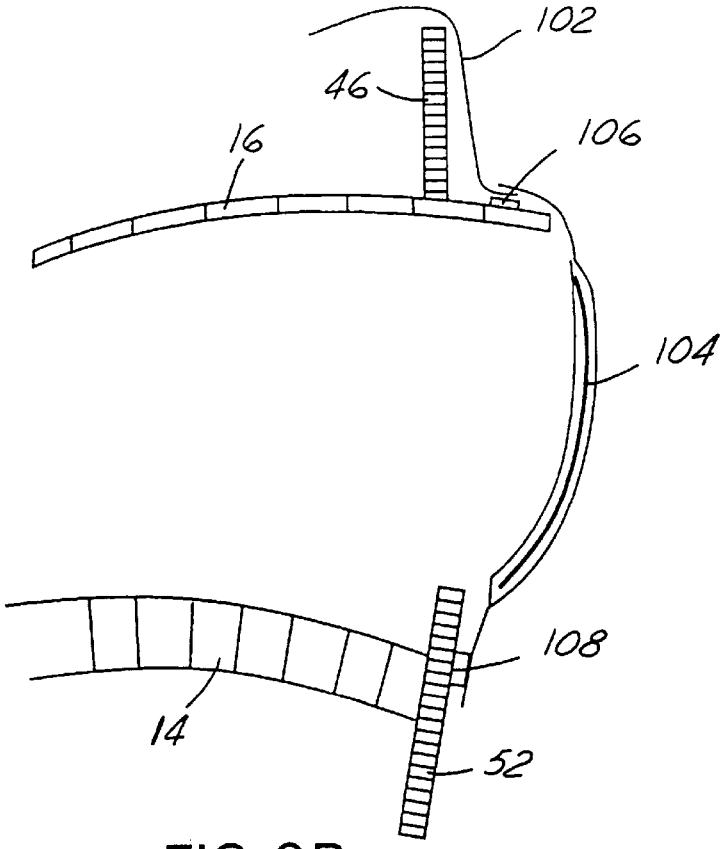
FIG. 9B is a view of the reflectors in the deployed position with the blanket cover.

Referring now to FIGS. 9A and 9B, antenna 10 preferably includes a blanket 102 suitable for space travel. Blanket 102 covers rear shell 16 and is connected to side panels 52 of front shell 14 by a blanket tensioner spring 104. Blanket tensioner spring 104 includes an elastomeric structure. Blanket tensioner spring 104 is connected to a mount 106 on rear shell 16 and a mount 108 on front shell 14.

Thus it is apparent that there has been provided, in accordance with the present invention, an antenna having dual movable reflectors that fully satisfies the objects, aims, and advantages set forth above. While the present invention has been described in conjunction with specific embodiments thereof, it is evident that many alternatives, modifications, and variations will be apparent to those skilled in the art in light of the foregoing description.

For instance, more than one moving mechanism may be used to move the reflectors apart. Furthermore, the moving mechanism may be located anywhere along the surfaces of the reflectors. Accordingly, it is intended to embrace all such alternatives, modifications, and variations as fall within the spirit and broad scope of the appended claims.

What is claimed is:

1. A dual reflector antenna comprising:

a first reflector for transmitting a signal;

a second reflector for receiving a signal;

a hinge connecting the reflectors together at a first end; and a moving mechanism connecting the reflectors at a second end opposite from the first end, the moving mechanism movable to move the reflectors between a stowed position in which the reflectors overlap each other and are positioned within a given distance from each other, and a deployed position in which the reflectors overlap each other and are spaced farther apart than the given distance from each other.

2. The antenna of claim 1 wherein:

the moving mechanism is a spring-loaded hinge.

3. The antenna of claim 1 wherein:

the moving mechanism is connected to outer peripheral portions of the reflectors.

4. The antenna of claim 1 wherein:

a portion of the reflectors pivot about a hinge axis as the moving mechanism moves the reflectors.

5. The antenna of claim 1 further comprising:

an aft lock for locking the reflectors in the stowed position.

6. The antenna of claim 5 further comprising:

a forward lock for locking the reflectors in the stowed position.

7. The antenna of claim 6 wherein:

the forward lock includes a hinge defining a hinge axis for a portion of the reflectors to pivot about as the reflectors are moved.

8. A satellite comprising:

a storage compartment; and a dual reflector antenna having a first reflector for transmitting a signal, a second reflector for receiving a signal, a hinge connecting the reflectors together at a first end, and a moving mechanism connecting the reflectors at a second end opposite from the first end, wherein the moving mechanism is movable to move the reflectors between a stowed position in which the reflectors overlap each other and are positioned within a given distance from each other to enable storage in the storage compartment and a deployed position in which the reflectors overlap each other and are spaced farther apart than the given distance from each other after removal from the storage compartment.

9. The satellite of claim 8 further comprising:

a boom connecting the antenna to the satellite.

* * * * *